US007767897B2

(12) United States Patent
Jochelson et al.

(10) Patent No.: US 7,767,897 B2
(45) Date of Patent: Aug. 3, 2010

(54) BEAT MATCHING FOR PORTABLE AUDIO

(75) Inventors: Daniel S Jochelson, Dallas, TX (US); Stephen J Fedigan, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 12/388,608

(22) Filed: Feb. 19, 2009

(65) Prior Publication Data

US 2009/0178542 A1 Jul. 16, 2009

Related U.S. Application Data

(62) Division of application No. 11/469,745, filed on Sep. 1, 2006, now Pat. No. 7,518,053.

(60) Provisional application No. 60/713,793, filed on Sep. 1, 2005.

(51) Int. Cl.
*G04B 13/00* (2006.01)
*A63H 5/00* (2006.01)

(52) U.S. Cl. ..... 84/609; 84/615; 84/616; 84/649; 84/653; 84/654

(58) Field of Classification Search ..... None
See application file for complete search history.

(56) References Cited

U.S. PATENT DOCUMENTS 5,614,687 A * 3/1997 Yamada et al. ..... 84/662
7,041,892 B2 * 5/2006 Becker ..... 84/603
7,601,907 B2 * 10/2009 Kobayashi ..... 84/613
2003/0221544 A1 * 12/2003 Weissflog ..... 84/667
2004/0069123 A1 * 4/2004 Becker et al. ..... 84/612
2004/0177746 A1 * 9/2004 Becker ..... 84/612

OTHER PUBLICATIONS

Scheirer, "Tempo and Beat Analysis of Acoustic Musical Signals", 103 J. Acoustical Soc. Am. 588, 1998.

Alonso, David, Richard "Tempo and Beat Estimation of Musical Signals", Proc. Intl. Conf. Music Information Retrieval, Oct. 2004.

Wong, Au, "Fast SOLA-Based Time Scale Modification Using Modified Envelope Matching," IEEE ICASSP vol. III, pp. 3188-3191, 2002.

Ramstad, "Digital Methods for Conversion between Arbitrary Sampling Frequencies," 32 IEEE Tr. ASSP 577-591, Jun. 1984.

Klapuri, "A Perceptually Motivated Multiple-F0 Estimation Method," Oct. 16-19, 2005.

(Continued)

*Primary Examiner*—Marlon T Fletcher
(74) *Attorney, Agent, or Firm*—Mirna Abyad; Wade J. Brady, III; Frederick J. Telecky, Jr.

(57) ABSTRACT

Beat matching for two audio streams extracts beats from each, computes a conversion ratio from one stream to the other stream by an initial beat alignment plus a stability-maintaining beat alignment. A variable resampling converter or time scale modifier adjusts one stream to align beats with those of the other (reference) stream. Thus for cross-fading two music streams the beats of the fading-in stream can be matched to those of the fading-out stream for a seamless transition.

5 Claims, 10 Drawing Sheets

OTHER PUBLICATIONS

Alonso, Badeau, David, Richard, "Musical Tempo Estimation Using Noise Subspace Projections," Oct. 19-22, 2003.
Sorensen, Burrus, "Efficient Computation of the DFT with Only a Subset of Input or Output Points," Mar. 1993.
Alonso, Richard, David, "Extracting Note Onsets from Musical Recordings," 2005.
Makhoul, El-Jaroudi, "Time-Scale Modification in Medium to Low Rate Speech Coding," 1986.
Amir, Ponceleon, Blanchard, Cohen, "Using Audio Time Scale Modification for Video Browsing," 2000.
Fedigan, Jochelson, "A Real-Time Beat Detection Algorithm for the C55xTM Family of DSPs".

* cited by examiner

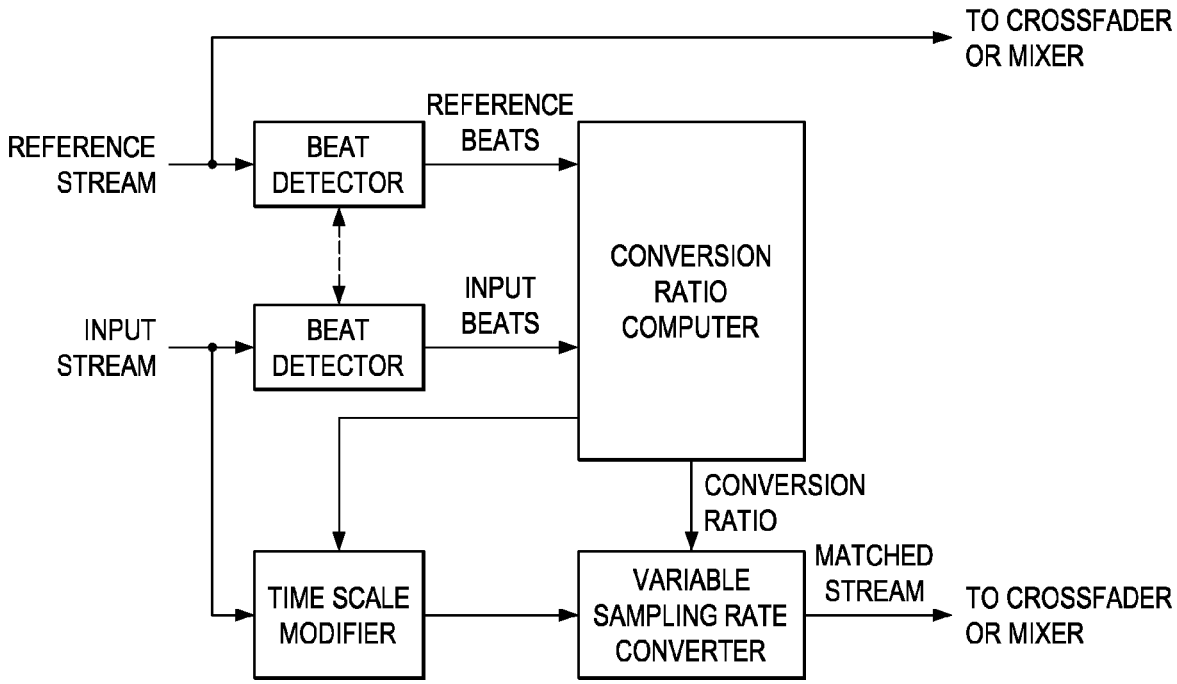
FIG. 4a
FIG. 4b
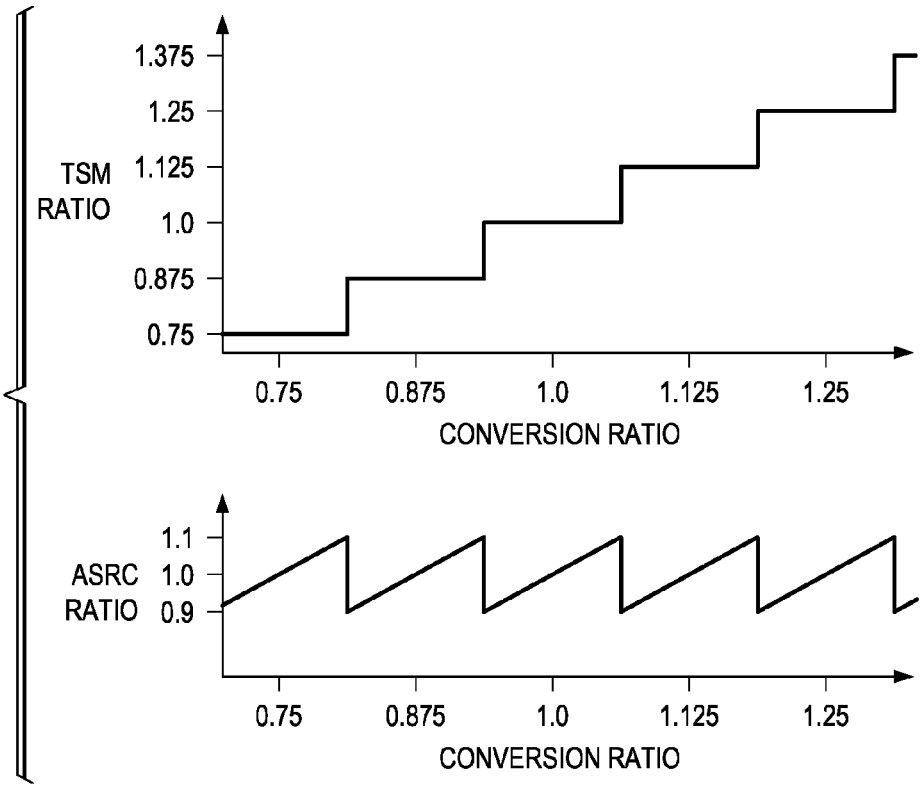

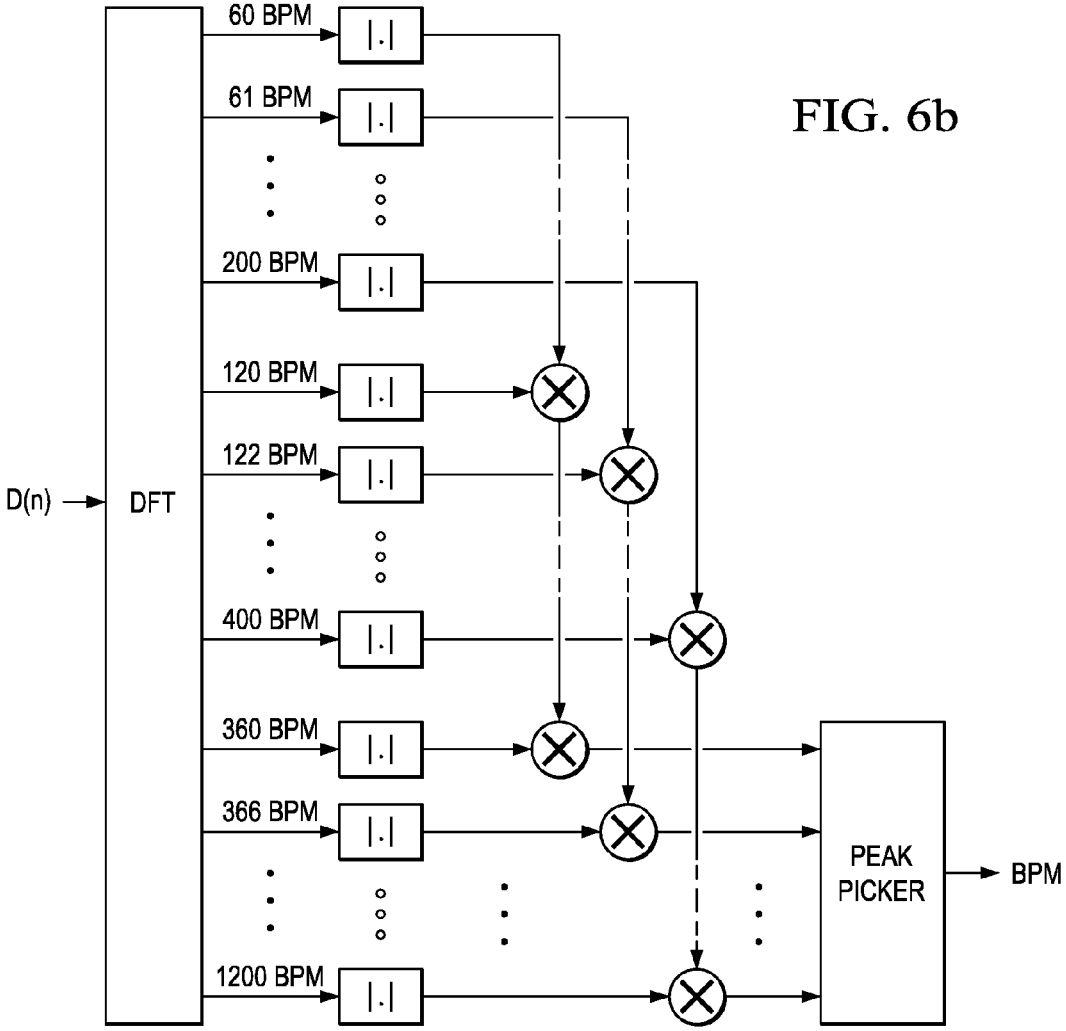
FIG. 6b
FIG. 6c
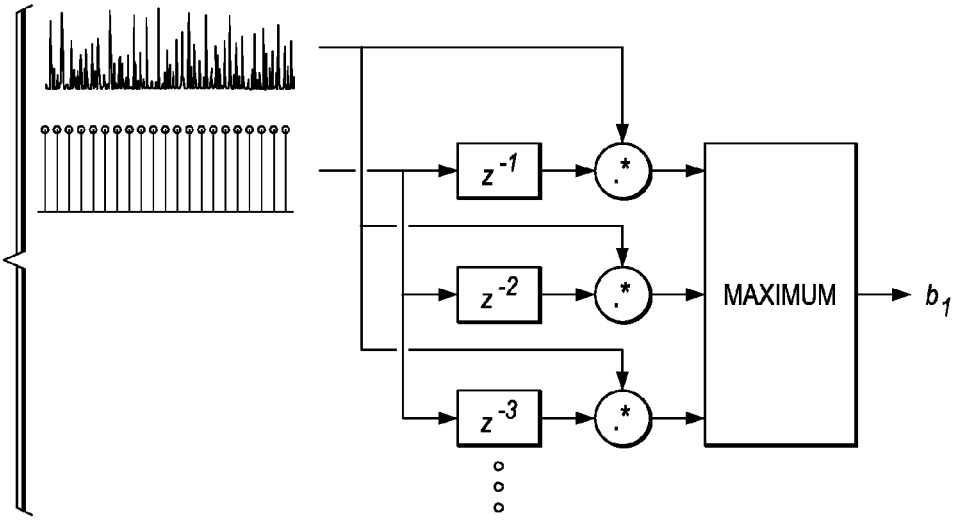

BEAT MATCHING FOR PORTABLE AUDIO

CROSS-REFERENCE TO RELATED APPLICATIONS

This application is a division of application Ser. No. 11/469,745, filed Sep. 1, 2006, now U.S. Pat. No. 7,518,053 which claims priority from U.S. provisional patent Appl. No. 60/713,793, filed Sep. 1, 2005. Co-assigned U.S. Pat. No. 7,345,600, issued Mar. 18, 2008, discloses related subject matter.

BACKGROUND OF THE INVENTION

The invention relates to electronic devices, and, more particularly, to circuitry and methods for beat matching in audio streams.

In recent years, methods have been developed which can track the tempo of an audio signal and identify its musical beats. This has enabled various beat-matching applications, including beat-matched audio editing, automatic play-list generation, and beat-matched crossfades. Indeed, in a beat-matched crossfade, a deejay slows down or speeds up one of the two audio tracks so that the beats between the incoming track and the outgoing track line up. When the tracks are from the same musical genre and the beat alignment is close, the transition sounds nearly seamless. After the outgoing track is gone, the incoming track beats can be ramped back to their original rate or maintained at the new rate, and this incoming track will eventually become the next outgoing track for the next cross-fade.

All beat matchers must mitigate the limitations of the beat detection method which they employ. This includes the tendency of beat detectors to jump from one tempo beats-per-minute value to a harmonic or sub-harmonic thereof between analysis frames.

Beat detection can be performed in various ways. A simple approach just computes autocorrelations and selects the beat period as the delay corresponding to the peak autocorrelation. In contrast, Scheirer, "Tempo and Beat Analysis of Acoustic Musical Signals", 103 J. Acoustical Soc. Am. 588 (1998), employs a psychoacoustic model that decomposes the audio signal into bands via filterbanks and then performs envelope detection on each of these bands. It then tests various beat rate hypotheses by employing resonant comb filters for each hypothesis. However, the computational complexity of Scheirer limits applicability on portable devices. Alonso et al., "Tempo and Beat Estimation of Musical Signals", Proc. Intl. Conf. Music Information Retrieval (ISMIR 2004), Barcelona, Spain, October 2004, proceeds through three steps: First an onset detector analyzes the audio signal and produces scalars that reflect the level of spectral change over time; this uses short-time Fourier transforms and differences the frequency channel magnitudes. The differences are summed and a threshold is applied through a median filter to output a detection function that shows only peaks at points in time that have large amounts of spectral change. Second, the detection function is fed to a periodicity estimator which applies spectral product methods to evaluate tempo (beat rate) hypotheses; this gives the beat rate estimate. In the third step a beat locator uses the detection function and the estimated beat rate to determine the locations of the beats in a frame.

Another important characteristic for beat matchers is to avoid excessively modifying the input music being matched to another (reference) music or beat source track. Typically, modifications are either time-scale modifications (TSM) or sampling rate conversions (SRC). FIG. 2*a* generally shows a beat matching (input beats bi[k] modified to align with reference beats br[k]), and FIG. 2*b* illustrates TSM versus SRC. For shrinking/expanding a time scale, TSM essentially deletes/replicates some information to preserve local structure, whereas SRC uniformly shrinks/expands everything.

TSM methods change the time scale of an audio signal without changing its perceptual characteristics. For example, synchronized overlap-and-add (SOLA) provides a time scale change by a factor r by taking successive length-N frames of input samples with frame k starting at time $kT_{analysis}$ and aligning frame k to (within a range about) its target synthesis starting time $kT_{synthesis}$ (where $T_{synthesis}=rT_{analysis}$) in the currently synthesized output by optimizing the cross-correlation of the overlap portions and then adding aligned frame k to extend the currently synthesized output with averaging of the overlap portions. Various SOLA modifications lower the complexity of the computations; for example, Wong and Au, Fast SOLA-Based Time Scale Modification Using Modified Envelope Matching, IEEE ICASSP vol. III, pp. 3188-3191 (2002).

Sampling rate conversion (which may be asynchronous) theoretically is just analog reconstruction and resampling, i.e., non-linear interpolations. Ramstad, Digital Methods for Conversion between Arbitrary Sampling Frequencies, 32 IEEE Tr. ASSP 577 (1984) presents a general theory of filtering methods for interfacing time-discrete systems with different sampling rates and includes the use of Taylor series coefficients for improved interpolation accuracy.

Simplistic beat matchers have problems including jumps in detected tempos over time and extreme conversion ratios that produce unnatural-sounding audio outputs. In addition, a stable beat matcher that produces natural-sounding audio output in real-time (and on an embedded/portable system) has not been found in previous literature.

SUMMARY OF THE INVENTION

The present invention provides automatic beat matching methods which avoid harmonic jumps and/or minimize time-scale modifications with a look-back plus harmonic analysis of detected tempos.

The preferred embodiment beat matchers allow for use in portable audio/media players and with various sources of reference beats.

BRIEF DESCRIPTION OF THE DRAWINGS

FIGS. 2*a*-2*b* show beat-matching waveforms and time-scale modification versus sampling rate conversion.

FIGS. 4*a*-4*b* show a third preferred embodiment beat matching.

FIGS. 6*a*-6*e* show beat detection.

DESCRIPTION OF THE PREFERRED EMBODIMENTS

1. Overview

Figure 5A:
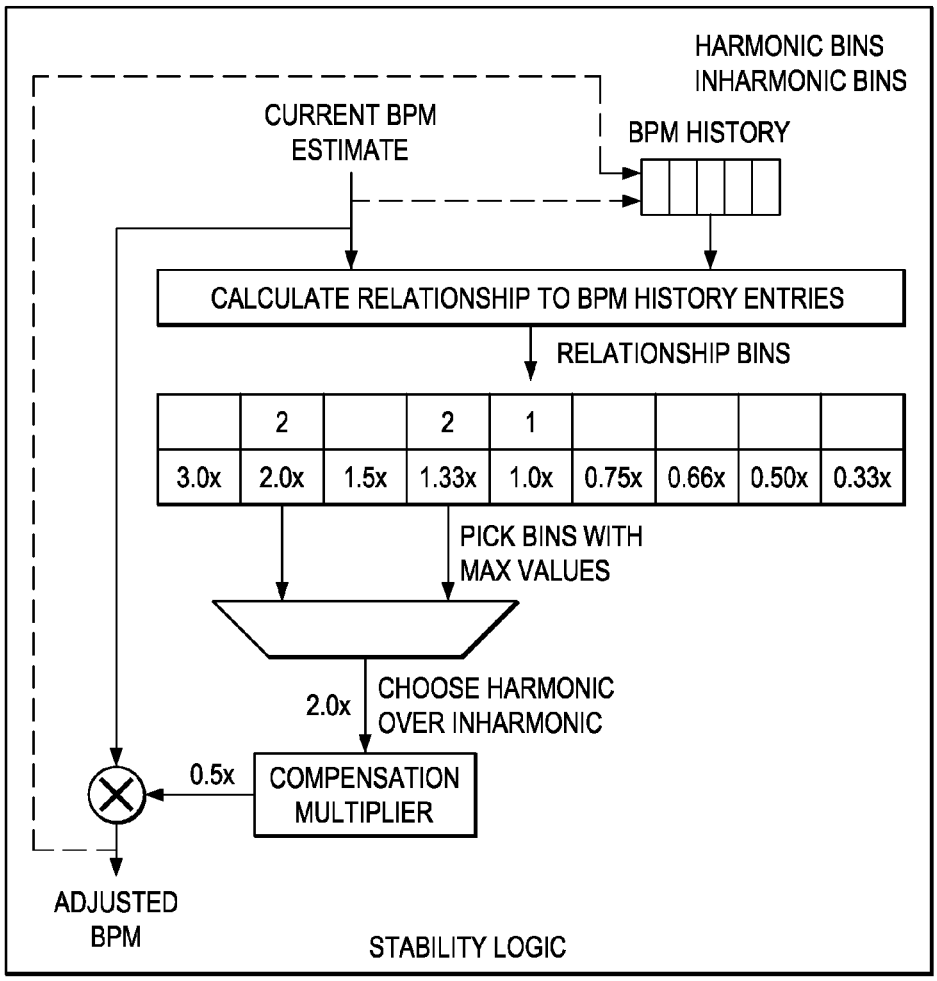
FIGS. 5*a*-5*b* illustrate a preferred embodiment beat detection stability loop.
Figure 5B:
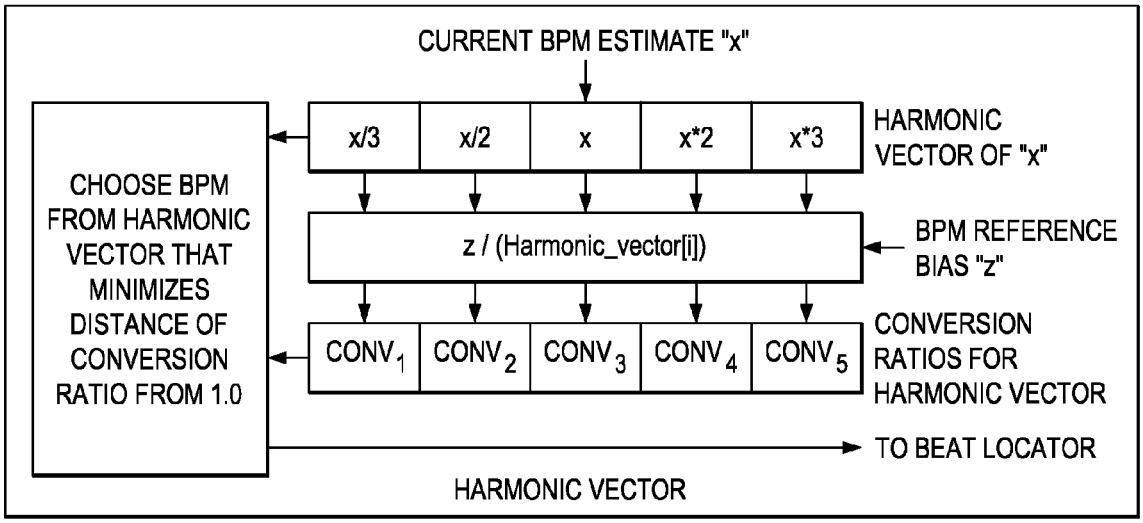

Preferred embodiments provide architectures and methods for beat matching by detecting beats in an input stream and a reference stream or source, computing a conversion ratio, and applying the conversion ratio to the input stream by a variable sampling rate converter (or asynchronous sampling rate converter, ASRC) and/or a time scale modifier (TSM) where look-back analysis of tempo provides stability against detection of beat harmonics and pitch jumps. FIGS. 1*a*-1*b*, 3, and 4*a* illustrate overall architectures, and FIGS. 5*a*-5*b* illustrate tempo stabilization. FIG. 1*c* is a flowchart.

Figure 8:
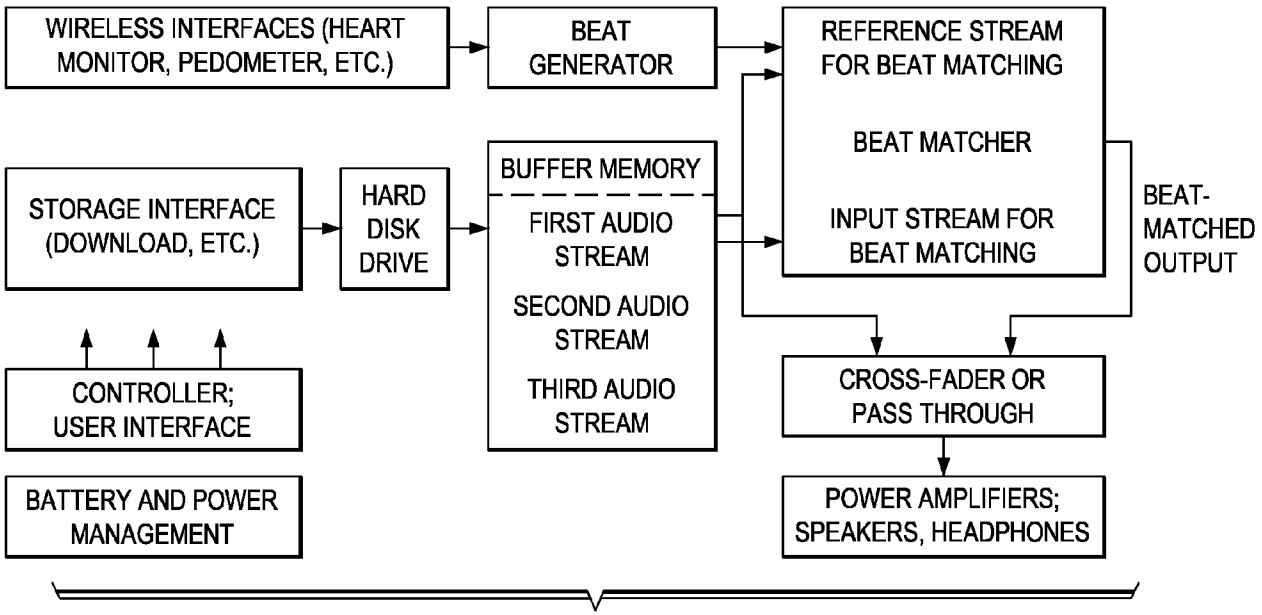
FIG. 8 illustrates functional blocks of a portable system with beat matching applications.

Preferred embodiment beat-matching provides low-complexity and allows use in portable audio/media players for applications such as (1) beat-matched crossfades, (2) beat-matched mixing, and (3) for sports applications where the tempo of a track is synchronized with a beat source, for example, a pedometer or heart rate monitor, or some other desired rate. FIG. 8 illustrates functional blocks of a portable player with beat matching capability for both cross-fades of stored music files and beat-matching of current selected music according to external (wireless) inputs such as a heart rate monitor or pedometer. This provides athletic applications such as training with music synchronized to a heart rate or the athlete's steps. Additionally, music tempo could be increased over an input heart rate to encourage more exertion and a higher heart rate, or decreased if the heart rate gets too high to encourage less exertion.

Preferred embodiment systems (e.g., digital audio players, personal computers with multimedia capabilities, et cetera) implement preferred embodiment architectures and methods with any of several types of hardware: digital signal processors (DSPs), general purpose programmable processors, application specific circuits, or systems on a chip (SoC) such as combinations of a DSP and a RISC processor together with various specialized programmable accelerators such as for FFTs and variable length coding (VLC). For example, the 55x family of DSPs from Texas Instruments have sufficient power. A stored program in an onboard or external (flash EEP) ROM or FRAM could implement the signal processing. Analog-to-digital converters and digital-to-analog converters can provide coupling to the real world, modulators and demodulators (plus antennas for air interfaces) can provide coupling for transmission waveforms, and packetizers can provide formats for transmission over networks such as the Internet.

2. First Preferred Embodiment Beat Matching

Figure 1A:
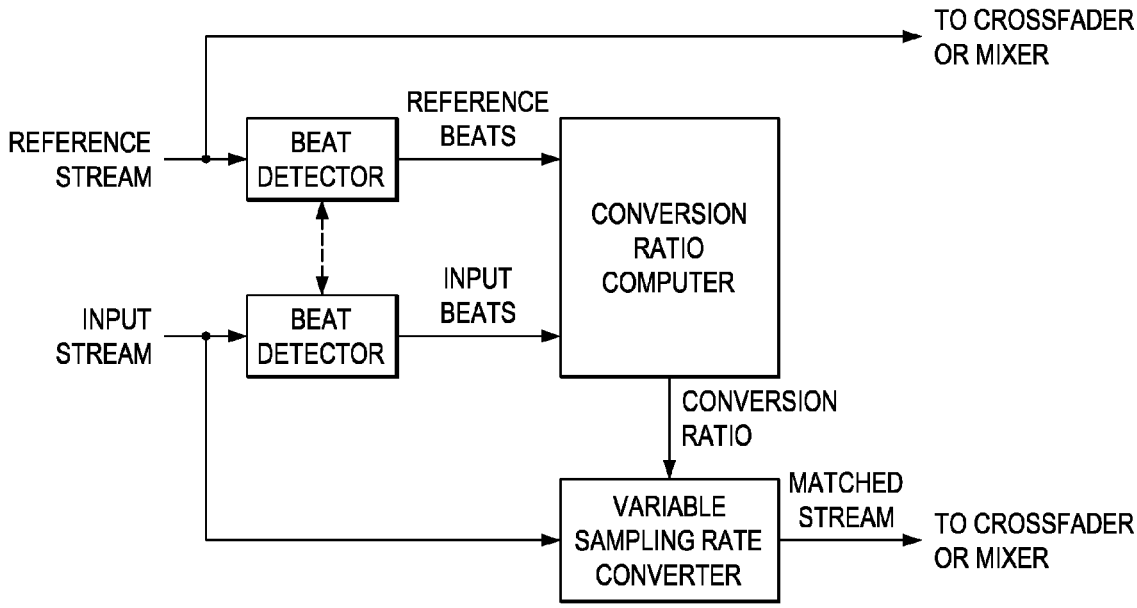
FIGS. 1*a*-1*d* are functional block diagrams and flowchart of a preferred embodiment beat matching architectures, plus an example for initial beat alignment.
Figure 1B:
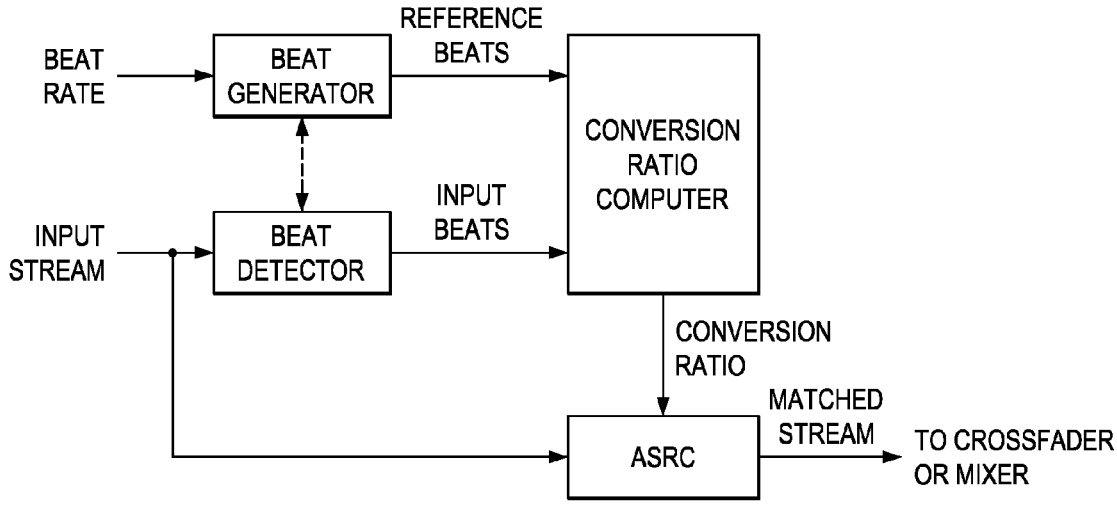
Figure 1C:
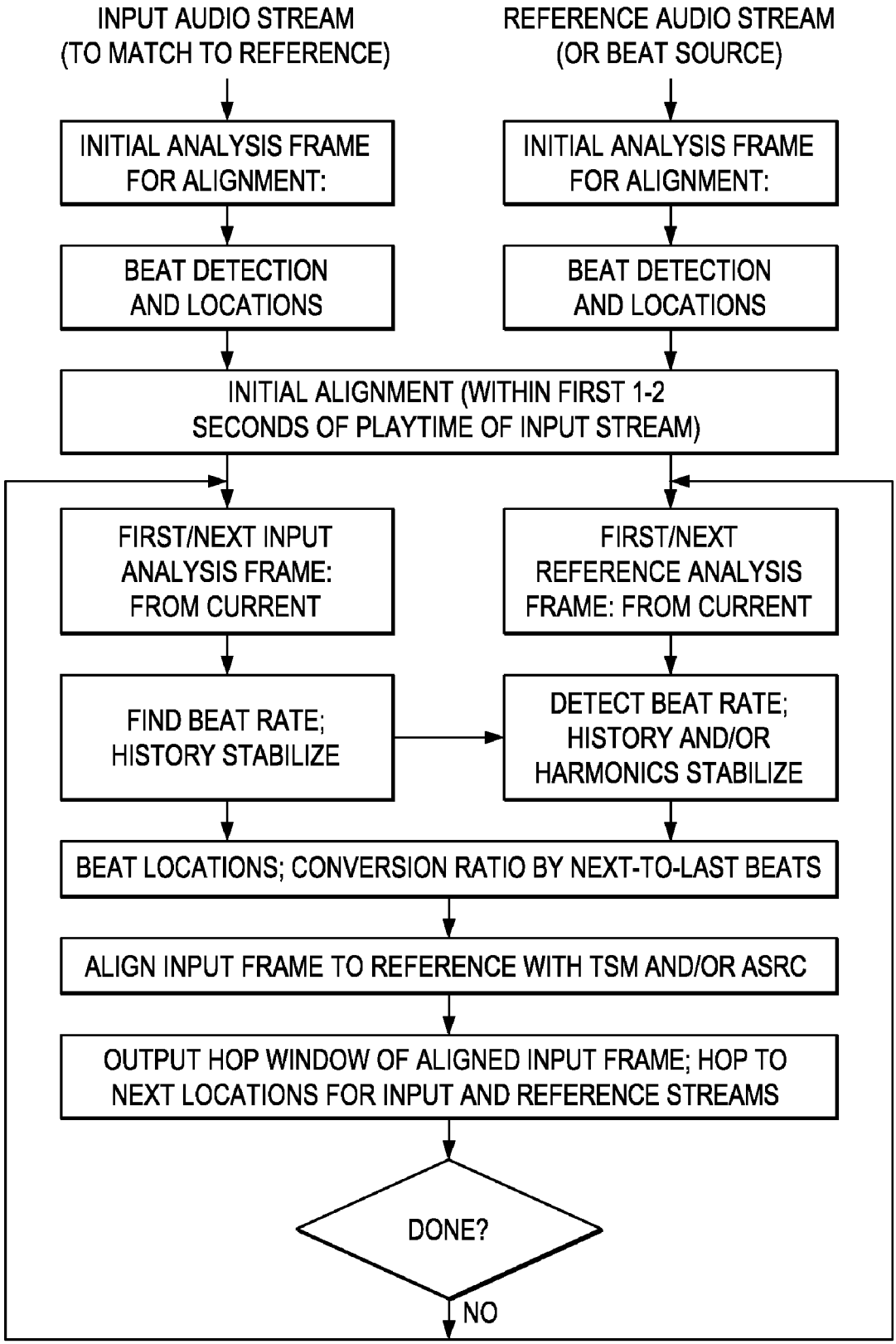

FIG. 1*a* illustrates functional blocks of a first preferred embodiment beat matching architecture which includes beat detectors, a conversion ratio computer, and a variable sampling rate converter; FIG. 1*c* is a flowchart. Sections 6 and 7 below describe a beat detector and a variable sampling rate converter, respectively.

The first preferred embodiment methods start with an initial alignment of the input digital audio stream to the reference stream by alignment of a beat detected near the beginning of the input stream with a beat detected in the reference stream, and then continue with beat-matching on a frame-by-frame basis using a variable sampling rate converter to modify the input stream to beat match the reference stream. The frames are 10-second intervals of stream samples, and adjacent frames have about a 50% overlap. Note that a 10-second interval corresponds to 441,000 samples when a stream has a 44.1 kHz sampling rate. Also, a tempo of 120 beats per minute (bpm) would yield about 20 beat locations detected in a frame. The frame size could be larger or smaller; the 10-second frame was selected as a compromise between accuracy and memory requirements. If the reference stream were a beat source such as a heart rate monitor, a pedometer, or even a software beat generator, where we are given only the rate of the beats, a beat location generator would provide the beat locations; see FIG. 1*b*.

In more detail, the first preferred embodiments proceed as follows where steps (a)-(e) provide an initial alignment of the input stream to the reference stream, and steps (f)-(l) maintain the alignment frame-by-frame. Explicitly, presume an input digital audio stream starting with samples $x_1, x_2, \ldots, x_j, \ldots$ and corresponding (in time) reference stream samples $y_1, y_2, \ldots, y_k, \ldots$ at the same sampling rate.

(a) Extract an initial analysis frame from the input stream as the samples $x_1, x_2, \ldots, x_F$ and similarly take an initial analysis frame for the reference stream as the samples $y_1, y_2, \ldots, y_F$; that is, the initial analysis frame for the input audio stream is the same size (and starts at the same time) as the initial analysis frame for the reference audio stream.

(b) Apply beat detection to the initial analysis frame for the reference stream to detect beats at samples $y_{br[1]}, y_{br[2]}, \ldots, Y_{br[N]}$ where typical values of the tempo (60 to 200 bpm) imply the number of detected beats, N, is expected to lie in the range 10 to 34. Simultaneously, apply beat detection to the initial analysis frame of the input stream to find beats at samples $x_{bi[1]}, x_{bi[2]}, \ldots, x_{bi[M]}$ where the number of beats, M, typically would also lie in the range 10 to 34. For the case of the reference stream being a beat source as in FIG. 1*b*, the beat location generator can provide the beat sample locations br[1], br[2], . . . with simple increments by the product of the sampling rate multiplied by the time between beat inputs; that is, br[n+1]=br[n]+(sampling rate)*(time interval from nth to (n+1)st beat inputs). The beat locations br[k] are generated until they would exceed the number of samples in an analysis frame.

Figure 1D:
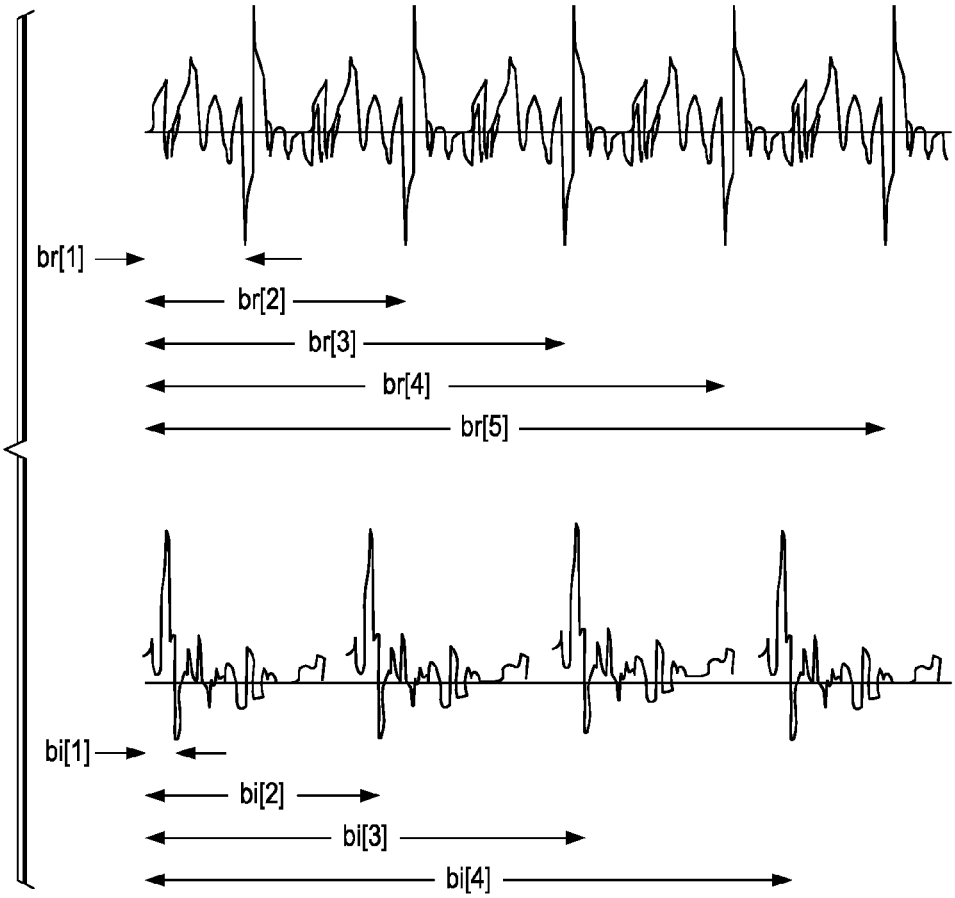
Figure 2A:
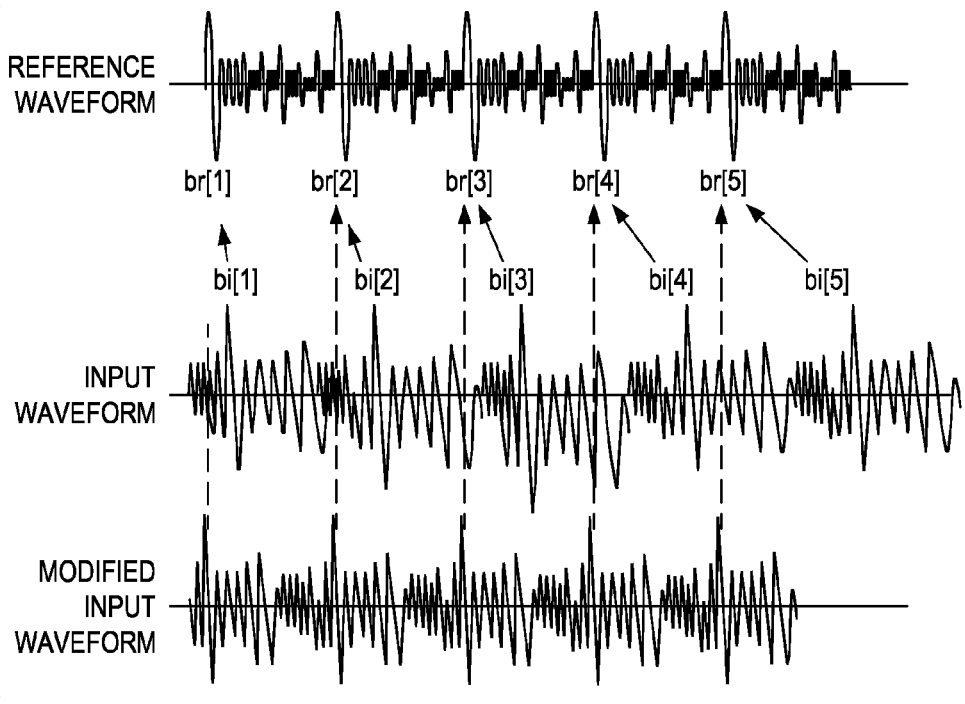

(c) Form the M×N matrix with the (j,k) entry equal to the ratio of jth and kth beat locations in the input and reference initial analysis frames, respectively; that is, the (j,k) entry is bi[j]/br[k]. FIG. 1*d* illustrates an example with N=5 and M=4; note that in this example bi[1] is very small because the first detected beat is close to the start of the frame, and that the ratios vary from small (i.e., bi[1]/br[5]), which denotes greatly slowing down the input stream, to large (i.e., bi[4]/br[1]), which denotes greatly speeding up this input stream.

(d) Find the element of the M×N matrix which is closest to 1.0; let this be element bi[j*]/br[k*]. This provides an initial alignment by essentially shifting the input stream so that the input beat at bi[j*] aligns with the reference beat at br[k*]. In the example of FIG. 1*d*, bi[2]/br[2] is about 0.85 and bi[3]/br[3] is about 1.1, so j*=3 and k*=3.

To avoid undue delay, a submatrix of the MxN matrix may be used to get an alignment early in the initial frame. That is, use the matrix formed from the beats located in the first 1-2 seconds of the initial frames; but this may only be a 1×1, 1×2, 2×1, or 2×2 matrix for low beat rates.

(e) Feed the input stream samples $x_1, x_2, \ldots, x_{bi[j^*]}$ to the sampling rate converter and convert the sampling rate using a conversion ratio of bi[j*]/br[k*], so bi[j*] input samples are consumed and br[k*] samples are output as the beat-matched version of the consumed input samples. And advance the index pointers (i.e., current sample locations in the streams) by bi[j*] for the input stream and by br[k*] for the reference stream; that is, the current sample location in both streams is one sample after a detected beat.

(f) Extract a first analysis frame with F samples for the reference stream starting at the current sample location (corresponding to location br[k*]+1 in the initial reference analysis frame) and also extract a first analysis frame with F samples for the input stream starting at the current sample location (corresponding to location bi[j*]+1 in the initial input analysis frame).

(g) Feed the two first analysis frames to the two beat detectors to find a first reference tempo Br and new reference beat locations br[1], br[2], . . . , br[N] (relative to the start of the first reference analysis frame) plus a first input tempo Bi and first input beat locations bi[1], bi[2], . . . , bi[M] (relative to the start of the first input analysis frame). Note that M and N may have changed from the initial analysis frame.

(h) Compute a conversion ratio for these first analysis frames from step (g) as r[1]=bi[K]/br[K] where $$K=\min(N,M)-1$$

Using the second-to-last beat (the −1 in the K definition) in the limiting stream frame avoids any boundary effects.

Also, this choice of r minimizes the cost function J(r) where:

$$J(r)^2=\Sigma_{1\leqq k\leqq K}(bi[k]-r\ br[k])^2/K$$

J(r) is the root-mean-squared distance between the individual reference beats and the time-scale-modified-by-ratio-r input beats.

This conversion ratio r[1] will be used in an ASRC or a variable sampling rate converter (see FIG. 1*a* "Variable Sampling Rate Converter") to resample a portion of the first input analysis frame to match beats with a corresponding portion of the first reference analysis frame. However, for the second and later analysis frames the conversion ratio r[n] will first be analyzed (and adjusted if needed) for stability with respect to prior conversion ratios and to harmonics; this is described below in section 5.

(i) Determine H, the hop number (the number of beats in a hop window) for these first analysis frames:

$$H=\min(\lfloor NT_{hop}/T_{frame}\rfloor,\lfloor MT_{hop}/T_{frame}\rfloor)-1$$

Here $\lfloor z\rfloor$ denotes the largest integer not greater than z (i.e., the floor function), $T_{hop}$ is the target length (duration) of a hop, $T_{frame}$ is the length (duration) of an analysis frame, and so $1-T_{hop}/T_{frame}$ is the overlap fraction of successive analysis frames in the limiting stream. Again, the second-to-last beat (the −1 in the H definition) in the limiting frame is used to avoid any boundary effects. The amount of overlap is a trade-off of computational complexity and stability. A convenient choice is 50% frame overlap:

$$H=\min(\lfloor N/2\rfloor,\lfloor M/2\rfloor)-1$$

As an example, if N=22 and M=21 (e.g., both the reference and input streams have a tempo of roughly 120 bpm in the first analysis frames which have 10 seconds duration), then K=20, the conversion ratio is r[1]=bi[20]/br[20], and the limiting stream is the input stream (i.e., M<N). Next, for 50% frame overlap, the hop number would be H=9; so 9 beats are to be matched to the reference during the resampling of the corresponding portion of the first input analysis frame.

The hop window in the first input analysis frame consists of the samples from the first sample through the bi[H]$^{th}$ sample, and the hop window in the first reference analysis frame consists of the samples from the first sample through the br[H]$^{th}$ sample. Roughly, the input hop window (bi[H] samples) will be converted to align with the reference hop window (br[H] samples).

(j) Using the conversion ratio r[1] from step (h), apply the ASRC to the first r[1]br[H] samples of the input analysis frame. The ASRC adjusts the time scale of the input audio stream so the beats in the hop window of the input frame align with beats in the hop window of the reference frame; section 7 provides details of the ASRC. This consumes r[1] br[H] input stream samples and outputs a set of br[H] modified input stream samples which are aligned with br[H] reference stream samples.

(k) Advance the index pointer for the current sample location in the reference stream to the location immediately following the reference hop window (e.g., advance br[H] samples), and advance the index pointer for the input stream to the samples immediately following the consumed samples (e.g., advance r[1]br[H] samples which is about equal to bi[H]). Making each frame hop occur about a beat boundary helps avoid any phase inaccuracies of beat locations in subsequent frames. Note that for the FIG. 1*b* case of the reference stream replaced by a beat source, there is only a virtual reference stream and the index pointer corresponds to the timing of beat br[H] because for the next virtual reference analysis frame its br[1] will be the computed as the product of the sampling rate multiplied by the time increment from the beat generating this br[H] to its succeeding beat, which will be at the new br[1] location in the next virtual reference analysis frame.

(l) Extract the next (nth) analysis frame (10 seconds) for both the input stream and the reference stream starting at the stream pointers (analogous to step (f)); feed the nth analysis frames to the corresponding beat detectors (analogous to step (g)), * this includes adjustment (if needed) of the input and/or reference nth tempos for frame-to-frame stability as described in section 5 below and illustrated in FIGS. 5***a*-5*b* (the harmonic adjustment of FIG. 5*b* only applies to the input stream's tempo); compute the conversion ratio r[n] for the nth analysis frames as the ratio of second-to-last beat locations (analogous to step (h)); compute the number of beats to hop (analogous to step (i)); apply ASRC to generate output according to the hop window (analogous to step (j)); and lastly, advance the index pointers according to hop window and samples consumed (analogous to step (k)). Repeat this step (l) until the desired beat matching is complete. However, to avoid boundary effects for the last analysis frame, shorten the hop window for the next-to-last frame so that the limiting last frame will be about the size of the analysis window. This ensures that a full beat detection analysis frame is available, and then, for this special case at the end, the hop size can be the same as the full analysis frame size.

3. Second Preferred Embodiment

Figure 3:
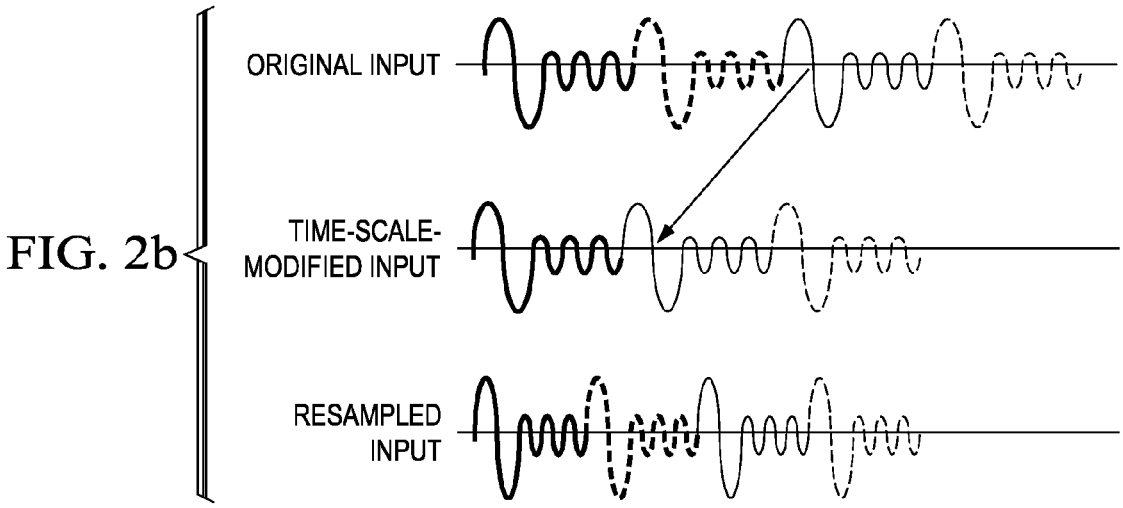
FIG. 3 illustrates a second preferred embodiment beat matching.
Figure 3:
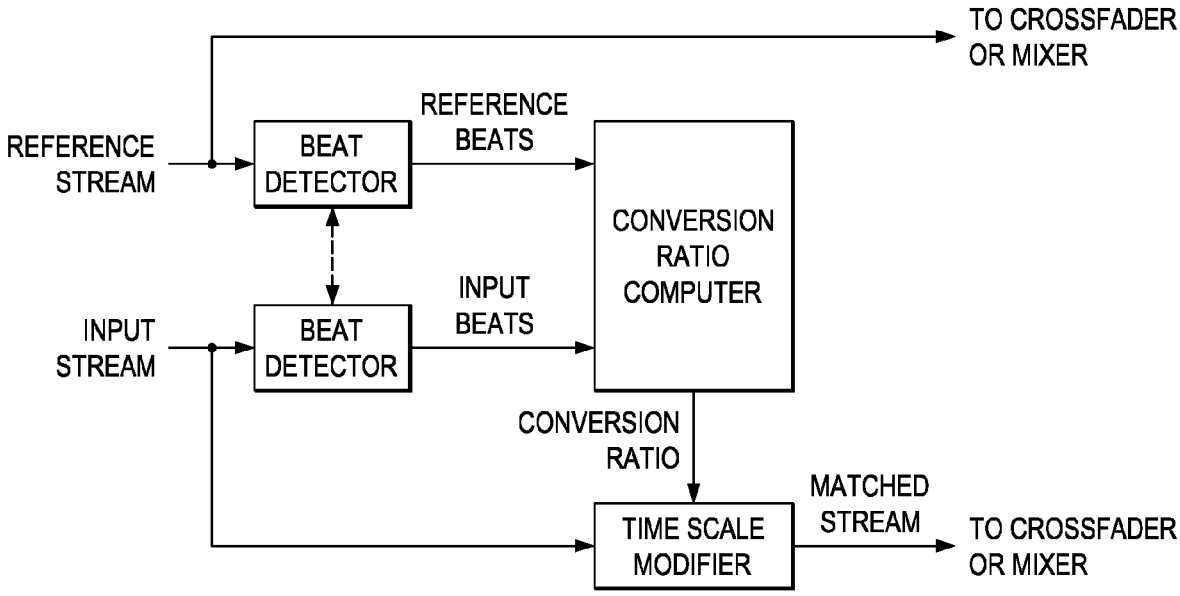

FIG. 3 shows a second preferred embodiment beat matching architecture which differs from that of FIG. 1*a* by replacement of the variable sampling rate converter with a time scale modifier (TSM). This TSM module may be used with fixed input/output buffer sizes (depending upon the conversion ratio/playback speed) and may have a playback speed resolution of 0.125. However, if the input/output buffer sizes were more flexible, this playback speed resolution could be much finer, allowing any change in playback speed with no pitch distortion artifacts. The previously described method with TSM replacing ASRC and the flowchart of FIG. 1*c* apply for the second preferred embodiment methods.

4. Third Preferred Embodiment

FIG. 4*a* shows a third preferred embodiment beat matching architecture which differs from that of FIGS. 1*a* and 3 by replacement of the ASRC or the TSM with a combination of a TSM followed by an ASRC. The TSM performs coarse adjustments to the time scale without causing the pitch distortion which exists in sampling rate converters generally. After the TSM, the ASRC performs a much finer pitch adjustment. Note that the order of the TSM and ASRC modules could be switched while still attaining the same beat-matching functionality. Again, the flowchart FIG. 1*c* and (with adaptations) the previously described methods provide the third preferred embodiment methods.

In particular, a third preferred embodiment method first computes the overall conversion ratio (R[n]) necessary to align the input stream beats in the nth frame to the reference stream (or beat source) beats; next, TSM and ASRC conversion ratios ($R_{TSM}[n]$ and $R_{ASRC}[n]$) are computed as:

$$R_{TSM}[n]=\lfloor R[n]/8+1/16\rfloor$$

$$R_{ASRC}[n]=R[n]/R_{TSM}[n]$$

when $|R[n]/R_{TSM}[n]-R_{ASRC}[n-1]|<|R[n]/R_{TSM}[n-1]-R_{ASRC}[n-1]|$, but otherwise as $$R_{TSM}[n]=R_{TSM}[n-1]$$

$$R_{ASRC}[n]=R[n]/R_{TSM}[n]$$

The division by 8 in defining $R_{TSM}[n]$ just reflects the step size of the TSM; with a different step size the divisor and round-off would adjust.

As previously mentioned, the TSM provides coarse time-scale modification (in 1/8 increments between 4/8 and 16/8) and the ASRC provides variable time-scale adjustments. In these formulas, two TSM+ASRC conversion ratios are computed, and the ASRC ratio closest to the previous value is selected (in order to avoid significant jumps in pitch). The first TSM ratio is obtained by rounding the overall conversion ratio to the nearest $1/8^{th}$ increment, and the first ASRC ratio is obtained simply by dividing the overall conversion ratio by the first TSM ratio (since the TSM+ASRC are connected in series). The second ASRC ratio is obtained by dividing the overall conversion ratio by the previous TSM ratio. As shown in FIG. 4*b*, using this scheme, the ASRC ratio varies between 0.90 and 1.10, which is slightly more than one semitone of pitch distortion.

5. Conversion Ratio Stability

The tempo reported by beat detectors has a tendency to jump between analysis frames. These tempo jumps can be to harmonics or simple ratios of the previously-detected tempos in prior analysis frames. That is, the current tempo may be a multiple such as 2×, 0.5×, 3×, 0.67×, 1.5×, 1.33×, etc. of a prior tempo. These jumps are highly disruptive to the beat matcher, as they cause large, audible jumps in the conversion ratios from frame to frame.

To remedy the tempo jump problem, the preferred embodiments maintain a history of prior tempo values for the stream (e.g., Bi for prior frames) and determine the ratios between the current (new) tempo and the previous tempos in the history; see FIG. 5*a* in which a tempo is denoted BPM (Beats Per Minute). In the example of FIG. 5*a* with a history of five prior tempos, compute the ratio of the current tempo divided by one of these five prior tempos and put this ratio into one of the nine relationship bins (which correspond to tempo ratios of 3.0, 2.0, 1.5, 1.33, 1.0, 0.75, 0.67, 0.5, and 0.33) if the ratio is within 5% of the bin tempo ratio; then repeat this ratio comparisons for the other four of the prior tempos. (If there is a true change of tempo, then likely none of the ratios will be within 5% of a bin ratio, and the bins will all be empty.) As an explicit example, if the current tempo is detected as 203 and the five prior tempos in the history are 102, 104, 153, 155, and 205 then the five ratios of the current tempo divided by a prior tempo are 1.99, 1.95, 1.33, 1.31, and 0.99. These count, respectively, as in the 2.0 bin, 2.0 bin, 1.33 bin, 1.33 bin, and 1.0 bin; see FIG. 5*a*. The bins that occur with the maximum frequency are selected. If only one bin has the maximum number, that bin is selected; whereas, if multiple bins contain the maximum number, the tie is broken by granting priority to those bins corresponding to harmonic relationships. The example of FIG. 5*a* shows the maximum 2 of the 5 ratios in the 2.0 bin and also the maximum 2 of the 5 ratios in the 1.33 bin; so the 2.0 bin is selected because the 2.0 ratio is a harmonic, whereas the 1.33 ratio is inharmonic.

Once a bin has been selected, the tempo is adjusted by multiplying the current (new) tempo by the inverse of the ratio of the selected bin. Thus the example of a current tempo of 203 and the selected bin ratio of 2.0 implies a multiplication by 1/2.0=0.5 as in the lower left of FIG. 5*a* to give an adjusted current tempo of 101.5.

As illustrated in FIG. 5*a*, after the stability analysis, there are two options for updating the tempo history: either the adjusted value can be stored (e.g., the 101.5 bpm of the example) or the unadjusted value can be stored (e.g., the 203 bpm of the example). Storing the adjusted tempo depresses change, whereas storing the unadjusted tempo enhances change. The preferred embodiments store the adjusted tempo for the reference stream (to provide less variation) and the unadjusted tempo for the input stream (to allow for tempo variation).

When the bpm values for the input and reference stream tempos are far apart, the conversion ratio can be far from 1.0. This can happen either because the tempos really are very far apart or because a harmonic or sub-harmonic of the actual tempo has been detected by the beat detector. To prevent the harmonic or sub-harmonic detection from giving a conversion ratio far from 1.0, the preferred embodiments first apply harmonic and sub-harmonic multipliers to the detected tempo of the input stream to give a set of tempos related to the input stream, and then compute the resulting conversion ratios (reference detected tempo divided by each input-stream-related tempo). The input-stream-related tempo with the conversion ratio closest to 1.0 is selected; see FIG. 5*b* with BPM denoting detected tempos and modified/related detected tempos and "ref_bias" denoting the reference detected tempo.

* The results of the tempo history and harmonics analysis of FIGS. 5***a*-5*b* have effects as follows:

(a) When there is no look-back adjustment to the tempos Bi and Br, and the conversion ratio closest to 1.0 is Q*Br/Bi, then we have the following cases:

(i) Q=1, no change;

(ii) Q=2 is interpreted as the reference stream was the limiting stream due to non-beats (such as second harmonics) being detected between true beats in the input stream. The beat rate, Bi, is adjusted by a factor of 2 to $Bi_{adj}$=Bi/2; and only about half as many beats will be located in the input analysis frame by the beat locator. While this changes the number of beats and the beat rate to $Bi_{adj}$ in the input analysis frame, it does not change the history stability of FIG. 5*a* (which uses the original beat rate), as this history stability logic is separate from the harmonic vector logic (FIG. 5*b*).

(iii) Q=3 is also interpreted as non-beats (such as third harmonics) being detected between true beats in the input stream. The detected beat rate, Bi, is adjusted by a factor of 3 to $Bi_{adj}$=Bi/3; and only about one third as many beats will be located in the input analysis frame. Again, while this changes the number of beats and the beat rate to $Bi_{adj}$ in the input analysis frame, it does not change the history stability of FIG. 5*a*.

(iv) Q=0.5 is interpreted as the input stream was the limiting stream due to about half of the beats not being detected in the input analysis frame; for example, if alternating beats are stronger and only the stronger beats were detected, then only about half of the beats would be detected. This implies the number of beats in the input analysis frame, M, should have been about 2M or 2M+1. Thus, the original detected beat rate, Bi, is doubled to $Bi_{adj}$=2*Bi before applying the beat locator within the beat detection module; again, the look-back stability is unaffected by this operation.

(v) Q=0.33 is interpreted again as beats not being detected in the input analysis frame; for example, if every third beat is stronger and only the stronger beats were detected, then only about one third of the beats would have been detected. This implies the number of beats in the input analysis frame, M, should have been about 3M or 3M+1 or 3M+2. Thus, the beat rate, Bi, is tripled to $Bi_{adj}$=3*Bi before applying the beat locator within the beat detection module; the look-back stability is unaffected by this operation.

(b) When there is a look-back adjustment to the tempo Bi, this adjustment is applied via the logic outlined in FIG. 5*a*. The Harmonic Vector logic (i.e. FIG. 5*b*) then uses this adjusted beat rate as it calculates the appropriate rate to achieve a conversion ratio closest to 1.0 (as outlined in case (a) above). And the beat locator uses the finally-adjusted input beat rate.

(c) When there is look-back adjustment to the reference tempo, the originally-calculated beat rate Br is adjusted and used by the beat locator for the reference analysis frame. Note that the FIG. 5*b* Harmonic Vector logic does not further adjust Br; the harmonic adjustment is only used when determining the input stream's beat rate adjustment; however, the look-back-adjusted Br is used as the divisor in the Harmonic Vector logic.

6. Beat Detection

FIGS. 6*a*-6*e* illustrate a beat detector's theory of operation as it estimates the period and locations of the musical beats; this is based on an algorithm by Alonso et al. The algorithm has three processing stages (shown in FIG. 6*a*): an onset detector, a periodicity estimator, and a beat locator. First, the onset detector uses a Short-Time Fourier Transform (STFT) as it converts consecutive blocks of audio data into scalar values that constitute a detection function (DF). The magnitude of the detection function indicates the degree of spectral change in the signal over time. Next, this detection function is fed into a periodicity estimator, which determines the beat period or beats-per-minute (BPM) of the audio stream by borrowing a method from the speech processing literature known as the spectral product. Finally, a beat locator uses the combination of the beat period and the detection function to determine location in time of the beats.

Figure 6A:
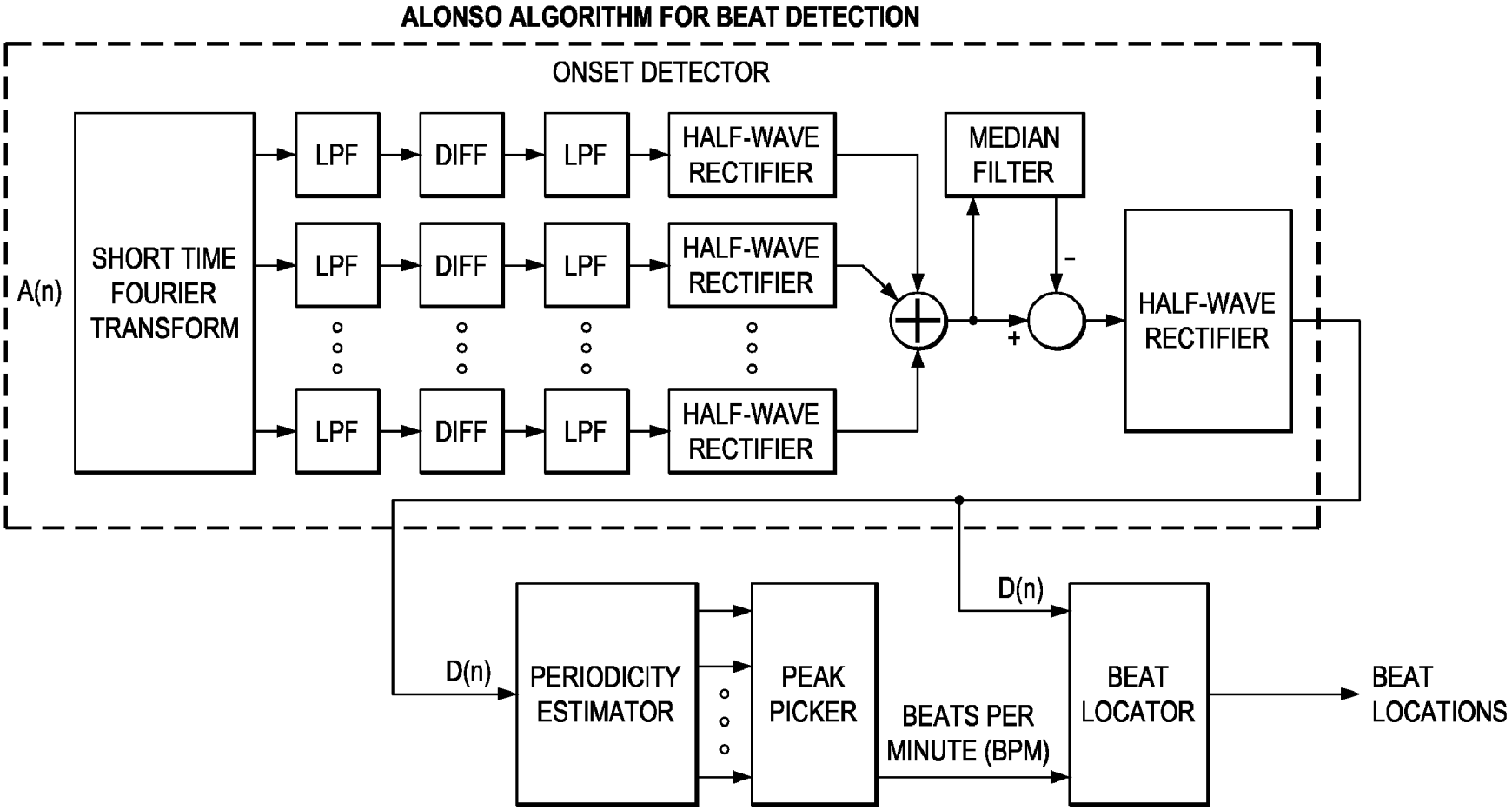

A detailed block diagram of the onset detector is also shown in FIG. 6*a*. It splits the audio signal into 128-point consecutive blocks and windows them to avoid edge effects. To increase frequency resolution, the windowed block is padded with 128 zeros, and the result is fed into a 256-point FFT. The magnitude of each frequency channel is computed, and then each is fed into a $19^{th}$ order FIR filter. This filter is the combination of a first order differentiator (DIFF) and a low-pass filter (LPF). All the positive filter outputs (half-wave rectified) are added together to form a scalar. To compute the final detection function output, a running median with a 35-sample window is subtracted from the original scalar.

The Periodicity Estimator's (PE) computational block diagram is shown in FIG. 6*b*. In the PE, we compute the DFT magnitudes for each BPM hypothesis and its 5 harmonics. These hypotheses range from 60 to 200 BPM with a resolution of 1.25 BPM (finer resolution is possible at cost of more processing cycles). The Spectral Product (SP) for each BPM value is the product for all 6 of these magnitudes. The BPM value with the greatest SP is considered the winner, and becomes the official BPM estimate. This periodicity estimation technique is borrowed from the speech processing literature.

After the PE selects a winner, it sends its winning BPM value to "stability logic", whose purpose it is to reduce the frame-to-frame variation of the BPM estimate. As previously described in connection with FIG. 5*a*, this logic computes the ratio between the current estimate and prior BPM estimates. The ratios are sorted into various relationship bins. The bin with the largest number of elements is selected, and a compensation multiplier is applied to the BPM estimate to keep it "in line" with prior estimates. If there is a tie between multiple bins, it is broken by a fixed prioritization scheme which gives precedence to simple integer relationships. After the BPM value is adjusted, the BPM history is updated with either the adjusted or unadjusted value.

For the beat matching application, a second layer of "harmonic" logic is applied, which was described in connection with FIG. 5*b*. Using this logic, a reference BPM value is divided into a harmonic vector, which is formed by multiplying/dividing the BPM estimate by simple integers. This calculation yields a vector of conversion ratios, and the BPM estimate is multiplied or divided by the factor which brings the conversion ratio closest to unity.

Figure 6D:
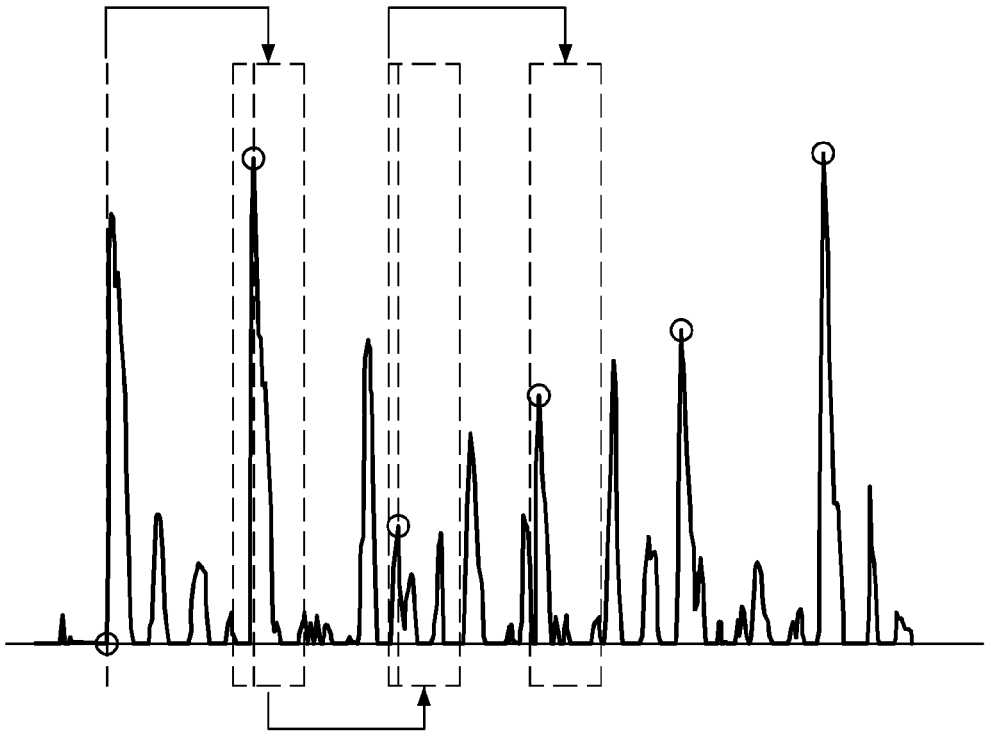

The Beat Locator determines the location of the first beat by constructing an impulse train at the estimated beat period. This impulse train is cross-correlated with the detection function. As shown in FIG. 6*c*, the time-shift corresponding to the peak of the cross-correlation function is selected. The method for locating subsequent beats is shown in FIG. 6*d*. The nominal location of the second beat is computed by adding the first location to the estimated beat period. This location is refined by finding the maximum DF value in the neighborhood about the nominal. The location corresponding to this local peak is taken to be the second beat location. However, if there is little difference between the minimum and maximum DF values over the search range, the nominal beat location is selected to avoid acting on noise. This process continues to find the remaining beats in the audio frame.

Figure 6E:
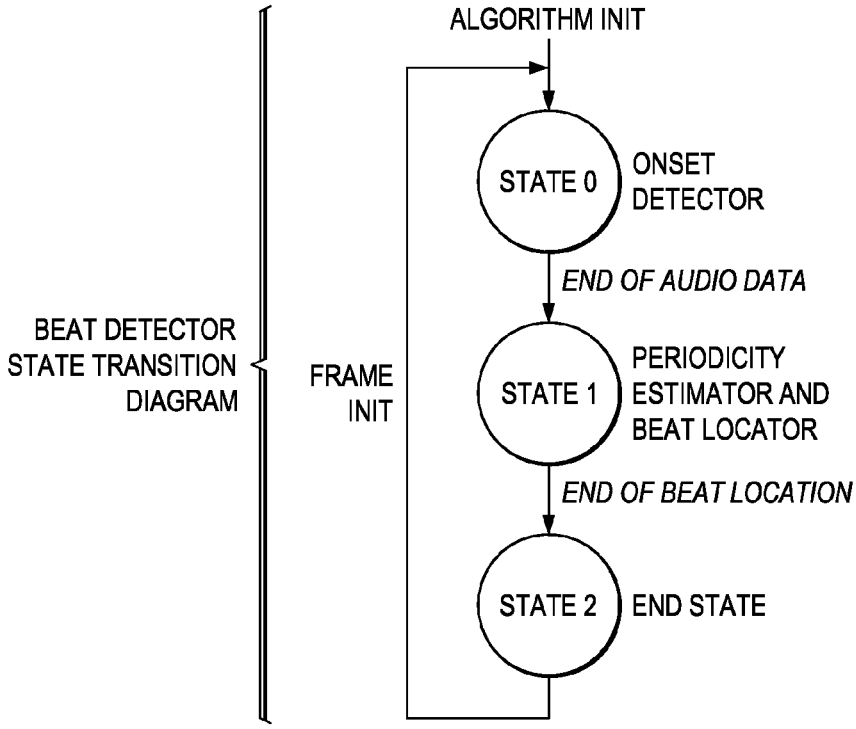

Some preferred embodiments implement the beat detector as a program on a programmable processor. To avoid having to process an inordinate amount of data in a single function call, the beat detector is implemented as a sequential state machine with 3 states as shown in FIG. 6*e*. This state machine can be used to handle the case where a processor's internal memory is limited, while the large audio data frames are stored in slower, external memory. This is a common situation in embedded systems for portable audio/media players. After initializing the method, the state is reset to 0 (onset detector). In state 0, the onset detector is fed one audio block at a time and produces one DF value for every 64 samples. To ensure continuity between audio blocks, the buffer size should be the declared block size (1024 is typical) plus 64 samples. The audio data pointer should point to element 65 in the buffer. For example, with a sampling rate of 48 kHz, a 10 second analysis frame consists of about 469 (=480,000/1024) blocks, and the onset detector outputs about 7500 DF values for the frame. These DF values could also be stored in external memory.

When the onset detection is completed, the state changes to 1. In this state, the periodicity estimator is to transform the sequence of 7500 DF values into the frequency domain to test BPM hypotheses. But rather than directly computing an 8192-point FFT, the preferred embodiment use a two-tier transform which is more efficient when only a limited number of frequencies are needed. In particular, for about 110 BPM hypotheses (from 60 to 200 with increments of 1.25) plus 5 more harmonics, only 660 frequencies are needed instead of the full 8192. Thus the preferred embodiments split the DF function sequence into 16 phases and pad each phase to 512 values (16*512=8192). Next, compute a 512-point FFT for each phase, and a DFT on selected transformed phase values to get the output frequencies corresponding to the BPM hypotheses, Then the spectral products are calculated for each BPM hypothesis and the winner is selected. This BPM is adjusted by the "stability" and "harmonic" logic, and the beats are located based on the adjusted BPM value. To indicate the completion of the frame, the state transitions to 2. To reset the state machine, the beat detector must be re-initialized. Once the beat-matching calculator uses these beat locations to compute the conversion ratio, the input audio data can be fed in small buffers (i.e. 1024 samples) to the VSRC module (i.e. data flow similar to that used to attain the detection function).

7. Variable Sampling Rate Converter

Figure 7:
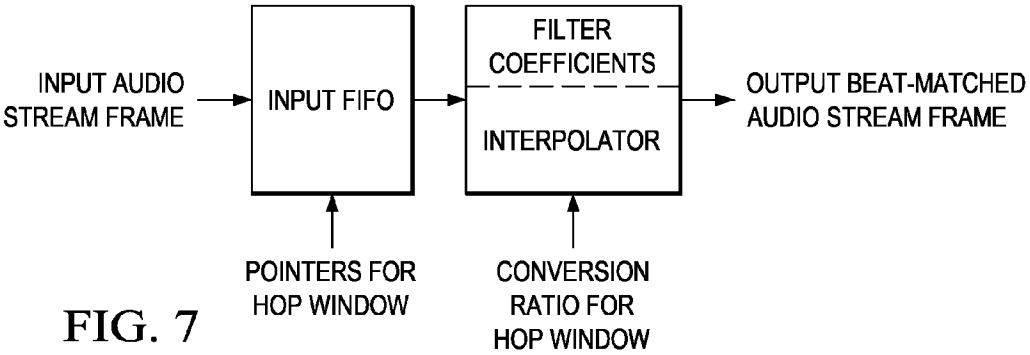
FIG. 7 shows functional blocks of a variable sampling rate converter.

The variable sampling rate converter of FIGS. 1*a* and 4*a* could have any of a number of structures provided the conversion ratio for a block of samples can be adjusted for each block. FIG. 7 illustrates generic functional blocks of a digital-filter-based converter. Indeed, first consider the "analog interpretation" of sampling rate conversion. Suppose $x_{in}(n)=x(nT_{in})$ are samples of an audio signal x(t) where t is time, n ranges over the integers, and $T_{in}$ is the sampling period. Presume x(t) is band-limited to $\pm F_{in}/2$, where $F_{in}=1T_{in}$ is the sampling rate; then the sampling theorem implies x(t) can be exactly reconstructed from the samples $x(nT_{in})$ via a convolution of the samples with an ideal lowpass filter impulse response:

$$x(t)=\Sigma_n h_{lowpass}(t-nT_{in})\times(nT_{in})$$

where $$h_{lowpass}(u)=\sin[\pi u/T_{in}]/(\pi u/T_{in})$$

To resample x(t) at a new sampling rate $F_{out}=1/T_{out}$, we need only evaluate the convolution at t values which are integer multiples of $T_{out}$; that is, $x_{out}(m)=x(mT_{out})$.

Note that when the new sampling rate is less than the original sampling rate, a lowpass cutoff must be placed below half the new lower sampling rate to avoid aliasing.

The lowpass filtering convolution can be interpreted as a superposition of shifted and scaled impulse responses: an impulse response instance is translated to each input signal sample and scaled by that sample, and the instances are all added together. Note that zero-crossings of the impulse response occur at all integers except the origin; this means at time t=nTin (i.e., at an input sample instant), the only contribution to the convolution sum is the single sample x(nTin), and all other samples contribute impulse responses which have a zero-crossing at time t=nTin. Thus, the reconstructed signal, x(t), goes precisely through the existing samples, as it should.

A second interpretation of the convolution is as follows: to obtain the reconstruction at time t, shift the signal samples under one fixed impulse response which is aligned with its peak at time t, then create the output as a linear combination of the input signal samples where the coefficient of each sample is given by the value of the impulse response at the location of the sample. That this interpretation is equivalent to the first can be seen as a change of variable in the convolution. In the first interpretation, all signal samples are used to form a linear combination of shifted impulse responses, while in the second interpretation, samples from one impulse response are used to form a linear combination of samples of the shifted input signal. This is essentially a filter of the input signal with time-varying filter coefficients being the appropriate samples of the impulse response. Practical sampling rate conversion methods may be based on the second interpretation.

The convolution cannot be implemented in practice because the "ideal lowpass filter" impulse response actually extends from minus infinity to plus infinity. It is necessary to window the ideal impulse response so as to make it finite. This is the basis of the window method for digital filter design. While many other filter design techniques exist, the window method is simple and robust, especially for very long impulse responses. Thus, replace $h_{lowpass}(u)=\sin[\pi u/T_{in}]/(\pi u/T_{in})$ with $h_{Kaiser}(u)=W_{Kaiser}(u)\sin[\pi u/T_{in}]/(\pi u/T_{in})$. In this case, the Kaiser window is given by:

$$w_{Kaiser}(t) = I_0\left(b\sqrt{(1-t^2/\tau^2)}\right)/I_0(b) \quad \text{for } |t|\le\tau$$
$$= 0 \quad \text{otherwise}$$

where $I_0(\ )$ is the modified Bessel function of order zero, $\tau=(N-1)T_{in}/2$ is the half-width of the window (so N is the maximum number of input samples within a window interval), and b is a parameter which provides a tradeoff between main lobe width and side lobe ripple height. Using this windowing method, the filter coefficients for a different cutoff frequency may be easily re-computed by changing the frequency of the sin(.) term in the above coefficient expression. This is advantageous in the beat matching application, where the cutoff frequency of the low-pass filter must be adjusted from one frame to the next to avoid aliasing.

To provide signal evaluation at an arbitrary time t where the time is specified in units of the input sampling period $T_{in}$, the evaluation time t is divided into three portions: (1) an integer multiple of $T_{in}$, (2) an integer multiple of $T_{in}/K$ where K is the number of values of $h_{Kaiser}(\ )$ stored for each zero-crossing interval, and (3) the remainder which is used for interpolation of the stored impulse response values or is fed into a subsequent continuous-time interpolator. That is, $t=nT_{in}+k(T_{in}/K)+f(T_{in}/K)$ where f is in the range [0,1]. For a digital processor, the time could be stored in a register with three fields for the three portions: the leftmost field gives the integer number n of samples into the input signal buffer (that is, $nT_{in}\leqq t<(n+1)T_{in}$ and the input signal buffer contains the values $x_{in}(n)=x(nT_{in})$ indexed by n), the middle field is the index k into a filter coefficient table h(k) (that is, the windowed impulse response values h(k)=hKaiser(kTin/K) so the main lobe extends to h(±K)=0), and the rightmost field is interpreted as a fraction f between 0 and 1 for doing linear interpolation between entries k and k+1 in the filter coefficient table (that is, interpolate between h(k) and h(k+1)) or for a low-order continuous-time interpolator. As a typical example, K=256; and f has finite resolution in a digital representation which implies a quantization noise of expressing t in terms of a fraction of Tin/K.

Define the sampling-rate conversion ratio r=Tout/Tin=Fin/Fout. So after each output sample is computed, the time register is incremented by r in fixed-point format (quantized); that is, the time is incremented by Tout=r Tin. Suppose the time register has just been updated, and an output xout(m)=x(t) is desired where mTout=t=nTin+k(Tin/K)+f(Tin/K). For r≦1 (the output sampling rate is higher than the input sampling rate), the output using linear interpolation of the impulse response filter coefficients is computed as:

$$x\mathrm{out}(m)=\Sigma j[h(k+jK)+f\Delta h(k+jK)]x\mathrm{in}(n-j)$$

where xin(n) is the current input sample (that is, nTin≦mTout<(n+1)Tin), and f in [0,1) is the linear interpolation factor with Δh(k+jK)=h(k+1+jK)−h(k+jK).

When r is greater than 1 (the output sampling rate is lower than the input sampling rate), one possibility is that the initial k+f can be replaced by, and the step-size through the filter coefficient table is reduced to K/r instead of K; this lowers the filter cutoff to avoid aliasing. Note that f is fixed throughout the computation of an output sample when 1≧r but f changes when r>1. Another possibility is that the filter coefficients may be re-computed with the help of a sine-wave generator.

For use in the preferred embodiment beat matching architectures and methods of FIGS. 1*a*, 3, and 4*a*, an input hop window of bi[H] samples within the nth input hop frame is resampled to give br[H] output samples which are beat matched to the br[H] samples in the nth reference analysis frame. Thus, the sampling-rate conversion ratio, r=Fin/Fout, is bi[H]/br[H] and thus equals r[n]. The time t corresponds to the current reference frame (or output) sample number in terms of input sample numbers; that is, each successive output sample is considered r[n] input samples farther into the input hop window. The conversion ratio for an input hop window of samples is provided to the sampling rate converter from the conversion ratio computer; see FIGS. 1*a* and 4*a*.

During a typical operating cycle for a sampling rate converter as in FIG. 7, the input FIFO is topped off with new input samples. At this time the input FIFO has the current input hop window samples plus prior samples and subsequent samples which are needed for the interpolations. This FIFO is not flushed between subsequent hops to maintain the continuity of the time-modified input stream. As output samples are generated, the level of the input FIFO is monitored. If the level dips below a threshold, the input FIFO is topped off to prevent underruns. The number of converted output samples is equal to the size of the reference hop.

The interpolator divides an output sample time t into its integer and fractional portions in terms of input sample numbers. The integer portion is the starting data index for the FIR filter in the interpolator, and the fractional part specifies the filter phase (of the polyphase filter). To reduce the noise caused by time quantization effects and to maintain a reasonable filter bank size, the remainder term may be divided into two portions where the first portion identifies which of the polyphase filters to select and where the second portion is used for a low-order continuous time interpolator.

After each output value is calculated by the interpolator, the "time" is incremented by the conversion ratio to obtain the "location" between the input samples for the next output sample. If the integer portion is incremented by 1, the starting index for the FIR filter data is advanced as well.

8. Modifications

The preferred embodiments may be modified in various ways while retaining one or more of the features of conversion ratio stability by look-back analysis and/or harmonic/subharmonic correction.

For example, the frame length could be varied from 10 seconds, even with an adaptive length, such as depending upon the closeness of the tempos.

The number of prior tempos used for stability analysis (FIG. 5*a*) could be varied from 5 to fewer or more (of course, for the first frame there is no history, for the second frame there is only 1 to use, for the third frame there are only 2, etc.). And a conversion ratio history could be used instead of the tempo for stability analysis.

When the beat detector for the input stream cannot reliably detect beats (detection below a threshold), the beat-matching could be suspended and the input stream unmodified and output to a cross-fader or other use.

To avoid detecting the same beat in successive frames, a fixed number of samples could be added to a hop window; for example, the reference hop window could be extended to br[H]+100. This also would help insure that the input samples consumed r[n](br[H]+100) would include the last beat of the input hop window at bi[H]. Note that the number of samples (at 44.1 kHz sampling rate) between beats typically lies in the range of 13000 to 53000, so any hop window extension of less than 1000 samples would easily avoid locations of successive beats including all low harmonics.

The input samples from the start of the initial analysis frame to the beat used for the initial alignment could be discarded (rather than converted) and thereby avoid conversion with a conversion ratio which is either very large or very small due to the streams being out of phase.

To attain stability between frames, the frame relationships can also be derived from the conversion ratio's relationship with previous beat-matching frames (i.e. keeping a conversion ratio history in addition to or instead of the BPM history in FIG. 5*a*). And the number of relationship bins could be varied from the nine in FIG. 5*a*.

The harmonic stability (FIG. 5*b*) or the beat rate stability (FIG. 5*a*) could be used without the other.

The hop number could be computed without the −1 which reflects the hop window not filling up the analysis frame in the limiting stream and thus automatically avoiding frame boundary effects. Note that frame overlap (which essentially determines hop size) is a tradeoff of stability (large overlap) with faster tracking (small overlap) and the −1 affects overlap. For example, with a low reference beat rate such as 50 bpm and a short analysis frame such as 5 seconds, the number of beats in a reference analysis frame will be 4 (the conversion ratio likely will use 3 beats) and with nominal 50% overlap, H=4/2−1=1, which is effectively 75% overlap.

The asynchronous sample rate converter (ASRC) when used in place of a variable sampling rate converter has its conversion ratio fixed and the ratio tracker turned off because the input and output clocks would be identical and the required conversion ratio is explicitly input.

What is claimed is:

1. A beat matcher, comprising:

(a) an input for a digital audio stream;

(b) an input beat detector coupled to said input, said input beat detector including stability logic for adjusting detected beat rates of successive frames, the input detector detects an nth input beat rate for an nth input frame of samples of said input digital audio stream;

(c) a reference beat rate source for finding beat locations for said nth reference frame using said nth reference beat rate and finding beat locations in said nth input frame using said nth input beat rate;

(d) a conversion ratio computer coupled to said input beat detector and to said reference beat rate source for computing an nth conversion ratio from said beat locations for said nth reference frame and said beat locations in said nth input frame; and (e) a sampled-stream converter coupled to said input and to said conversion ratio computer, whereby a digital audio stream at said input can be beat matched to beats of said reference beat rate source for computing an nth hop number from the number of said beat locations for said nth reference frame and the number of said beat locations in said nth input frame, defining an nth hop window for said nth reference frame using said nth hop number, computing an nth set of output samples from samples of said nth input frame using said nth conversion ratio where the number of samples in said nth set of output samples corresponds to said nth hop window determining an (n+1)th reference frame with beginning as following the end of said nth hop window and determining an (n+1)th input frame in said input audio stream by advancing in said input audio stream from the start of said nth input frame by a number of sample locations equal to the product of said nth conversion ratio multiplied by said number of locations corresponding to said nth hop window.

2. The beat matcher of claim 1, wherein said converter is a sampling rate converter.

3. The beat matcher of claim 1, wherein said converter is a time scale modifier.

4. The beat matcher of claim 1, wherein said converter is a sampling rate converter plus a time scale modifier in series.

5. A method of beat detection, comprising the steps of:

(a) providing a digital processor with internal memory, said processor operable to process a frame of samples;

(b) providing external memory coupled to said processor;

(c) storing a frame of audio samples in said external memory, said frame consisting of N audio blocks of samples where N is an integer greater than 100;

(d) transferring an audio block of samples from said external memory to said processor;

(e) computing discrete Fourier transforms of portions of said transferred audio block;

(f) filtering in each frequency of said transforms from (e) and combining said filterings to form detection function outputs;

(g) repeating (d)-(f) and storing said detection function outputs in said external memory;

(h) computing discrete Fourier transform values from said detection function values and for a set of frequencies corresponding to a set of beat rates and their harmonics, said computing in two steps:

(i) successively transferring a portion of said detection function values from said external memory to said processor and computing a discrete Fourier transform from said transferred portion of said detection function value;

(ii) after said discrete Fourier transforming of said portions of said detection function, computing discrete Fourier transform outputs for said set of frequencies from said discrete Fourier transforming of said portions of said detection function;

(i) computing for each of said beat rates a spectral product from corresponding ones of said discrete Fourier transform values from (h);

(j) from the results of (i), picking a winner beat rate from said beat rates; and (k) finding beat locations in said frame using said winner beat rate.

* * * * *